US006572714B1

(12) United States Patent
Kawahara et al.

(10) Patent No.: US 6,572,714 B1
(45) Date of Patent: Jun. 3, 2003

(54) FE-NI ALLOY FOR TENSION MASK AND TENSION MASK USING IT AND COLOR CRT

(75) Inventors: Tetsuo Kawahara, Kanagawa (JP); Norio Yuki, Kanagawa (JP); Kazuhiro Taki, Kanagawa (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/857,016

(22) PCT Filed: Oct. 21, 1999

(86) PCT No.: PCT/JP99/05802

§ 371 (c)(1),
(2), (4) Date: May 31, 2001

(87) PCT Pub. No.: WO00/36172

PCT Pub. Date: Jun. 22, 2000

(30) Foreign Application Priority Data

Dec. 15, 1998 (JP) ..... 10-356219

(51) Int. Cl.[7] ..... C22C 38/40

(52) U.S. Cl. ..... 148/336; 420/94

(58) Field of Search ..... 420/94; 148/336

(56) References Cited

U.S. PATENT DOCUMENTS 6,306,229 B1 * 10/2001 Ide et al. ..... 148/621

FOREIGN PATENT DOCUMENTS

| | | |
|---|---|---|
| JP | 62-120432 | 6/1987 |
| JP | 62-185860 | 8/1987 |

* cited by examiner

*Primary Examiner*—Deborah Yee
(74) *Attorney, Agent, or Firm*—Birch Stewart Kolasch & Birch LLP

(57) ABSTRACT

The creep property of a shadow mask, which has cathode-ray passing apertures, in the form of dots or slots formed by etching, and to which tension is then applied without undergoing press-forming, is enhanced. The Fe—Ni alloy containing from 30–50% of Ni, the balance consisting of iron and unavoidable impurities, has cold working temper of not less than 30% and not more than 57% of the final working degree.

18 Claims, 3 Drawing Sheets

FE-NI ALLOY FOR TENSION MASK AND TENSION MASK USING IT AND COLOR CRT

This application is the national phase under 35 U.S.C. §371 of PCT International Application No. PCT/JP99/05802 which has an International filing date of Oct. 21, 1999 which designated the United States of America and was not filed in English.

TECHNICAL FIELD

The present invention provides material having improved dorming property and excellent creep property and used for a mask of a cathode-ray tube (a Braun tube). An Fe—Ni based alloy is used for such mask. The present invention also provides a tension mask using this material and a color Braun tube using the above-mentioned tension mask.

BACKGROUND TECHNIQUE

The types of mask in a Braun tube are roughly classified into a shadow-mask type and an aperture-grill type. In the shadow-mask type, a dot or slot pattern is formed by etching, and press-forming is then carried out (hereinafter referred to as "the shadow-mask type by pressing"). In the aperture-grill type, a reed screen is formed by etching, and tension-application is then carried out. In the shadow-mask type by pressing, Fe-36% Ni alloy (Invar alloy) is generally used to improve the dorming property which is attributable to the thermal expansion of the shadow-mask. Important properties additionally required for the Fe—Ni based alloy are etching property, press formability and the like. On the other hand, a structural feature of the aperture-grill type is that the cathode-ray passing apertures are in the form of a reed screen. The dorming attributable to the thermal expansion of the mask is, therefore, unlikely to occur. Mild steel, which is less expensive than the Invar alloy, is, therefore, used, despite the high coefficient of thermal expansion of the mild steel. Each type has a merit and a demerit and is used in the market.

Recently, a type referred to as FTM (Flat Tension Mask), in which the respective merit of each type is employed, is newly under consideration. This type of mask is provided by the following method. A sheet etched in the form of dots or slots is not subjected to pressing but is subjected to application of vertical tension as in the aperture-grill type, and is supported on a frame member.

The description in Japanese Unexamined Patent Publication No. 10-50210, which belongs to the above-mentioned type, is cited now. As shown in FIGS. 1 and 2, the shadow mask 9 is provided inside the glass panel 2 which has an almost flat face screen plane 3 which is, in turn, provided in the flat-face type color cathode-ray tube 1. Sheet springs 8 are welded on the outer side of the frame member 7 made of metal and are engaged with a panel pin 5 which supports the frame member 7. The shadow mask 9 is, therefore, held in a predetermined position inside the glass panel 2.

An electron gun (not shown) is provided in the neck portion of a funnel 6 of the color cathode-ray tube 1 and emits the electron beam 10. The electron beam 10, which has passed through the apertures of the shadow mask 9 extended on the frame member 7, impinge upon the predetermined spots formed on the inner surface of a glass panel 2.

Referring to FIG. 1, the first band frame portion 14*b* surrounds the beam selecting region 12 having an almost rectangular shape and forming a shadow mask. The second band frame portion 14*a* is additionally provided outside the first band frame portion 14*b*. The second band frame portion 14*b* and the first band frame portion 14*a* are connected at plural portions by the joint portions 14*c*. In a plurality of the outer regions 13*a*, 13*b*, 13*c* surrounded by the first band-frame portion 14*b*, the second band frame portion 14*a*, and the joint portions 14*c*, a number of small apertures are provided as in the beam-selecting region 12. These small apertures have a slot shape or a round shape and are arranged in a predetermined pitch and pattern so as to enable the electron beam to pass therethrough. Small apertures are formed in the outer regions 13*a*, 13*b* and 13*c*. The flat member 11 to be used for a shadow mask, to which the tensional force is imparted, is welded on the frame member. Uniform tensional force is imparted to the entire beam-selecting region 12 during welding.

The second band frame portion 14*a* of the flat member 11 as described above is grasped on its four sides by a jig (not shown) and pulled outwards. The tensional force is thus applied to the entire face of the flat member 11. Under such a condition, the first band frame portion 14*b* is positioned relative to and is welded on the frame member (7 in FIG. 2). Portions outside the welded portions of the flat member 11, i.e., the outer regions 13*a*, 13*b*, 13*c*, the joint portions 14*c* and the second band frame portions 14*a*, are, subsequently cut off along the outer periphery 7 of the frame member 7. By such method, a shadow-mask assembly (color-selecting electrode) 17 consisting of the frame member 7 and the shadow mask 9 as shown in FIG. 3 is obtained. The color-selecting electrode 17 is mounted in the glass panel 2.

The FTM type described hereinabove with reference to the publication ibid allegedly attains more flattening of a shadow mask as well as high luminance and high resolution as compared with the shadow-mask type by pressing. In addition, the vibration property of the FTM type is better than that of the aperture-grill type. No damper wires, which bridge the Fe—Ni alloy strips in the form of a stripe pattern, are necessary. In addition, the vertically pulling load can be lessened. The FTM system contributes, therefore, to cost reduction.

Since the shape of the cathode-ray passing apertures in FTM is different from that of the aperture-grill type, the thermal expansion occurring in the former type leads to the dorming phenomenon. It has, therefore, been contemplated to use as a mask the Fe—Ni based alloys, Invar alloy among them having a low coefficient of thermal expansion. It was found that the Invar alloy, which had been conventionally employed in the shadow-mask type by pressing, brought about in the FTM type, serious drawbacks such that heat treatments such as blackening and baking result in a decrease of tensional load of the shadow mask in the assembling process of the shadow mask to a level that wrinkles were formed on the shadow mask. The alloys used in the conventional shadow-mask type are tempered to improve the press formability. The conventional Invar alloy, however, turned out to be inappropriate for the FTM type. The present inventors investigated the reason for this in detail in the respective production steps of a mask, and discovered that it is related to the creep property of the mask material.

Namely, in the FTM type, the etched mask material is subjected to blackening, and then is welded on the frame material. Tension is then applied to impart a constant load. Baking is then carried out. The Invar alloy is pulled by a frame, that is, the tension is applied to the Invar alloy. It was discovered that the Invar alloy plastically deformed under heat, that is, a creep phenomenon occurred. When the creep phenomenon occurs, the mask is elongated and hence relaxation of the load applied upon tensioning occurs. Such various problems as wrinkle-formation on the mask, impairment of the vibration performance are, therefore, incurred.

DISCLOSURE OF INVENTION

Namely, the present invention solves the above-described problems and provides: (1) Fe—Ni alloy having improved dorming property and creep property and used for a shadow mask, which has the cathode-ray passing apertures, in the form of dots or slots formed by etching, and to which tension is then applied without undergoing press-forming (hereinafter referred to as "the tension mask"), said Fe—Ni alloy containing from 30% by weight (the percentage below is "weight %" unless otherwise specified) to 50% of Ni, the balance consisting of iron and unavoidable impurities, and having not less than 30% and not more than 57% of the final working degree; (2) Fe—Ni alloy used for the tension mask according to item (1), mentioned above, characterized by limiting the impurity components to 0.01% or less of C, 0.20% or less of Si, 0.5% or less of Mn, 0.015% or less of P, and 0.010% or less of S; (3) Fe—Ni alloy used for the tension mask according to item (1) or (2), mentioned above, characterized by setting the final temper state to the cold-working finish and having 620 N/mm$^2$ or more of the tensile strength; (4) Fe—Ni alloy used for the tension mask according to items (1) through (3), mentioned above, characterized by limiting the final temper state to cold-rolling finish and having 610 N/mm$^2$ or more of yield strength (0.2%, the percentage of permanent elongation relative to the initial gauge distance of a test specimen, the same applies to the yield strength and the creep elongation); (5) a tension mask for which the Fe—Ni alloys of items (1) through (4) mentioned above are used; and (6) a color Braun-tube, which comprises the tension mask (5) and which enables flattening of the display and also enables high luminance and high resolution.

A general method for improving the creep property of metal is by means of adding an alloying element to suppress displacement of the dislocations. However, in the case of Fe—Ni alloy, the elements except for Co incur a rise the coefficient of thermal expansion and are, hence, not preferable in the light of dorming property. There is also a danger that satisfactory etching is impeded by precipitates newly formed due to the addition of alloying elements. In addition, the addition of Co,which is expensive, considerably increases the material cost, and cannot be at all said to be an advisable solution. The present inventors gave, therefore, consideration to a method, which is based on neither a substantial change in the Fe—Ni alloy composition per se nor a change in the production process, and which can avoid increase of the production cost.

The reasons for limiting the invention are hereinafter described.

Ni: When Ni is less than 30% or more than 50%, the thermal expansion coefficient of the Fe—Ni alloy becomes so great that the color purity of a color Braun tube is lowered. The range of Ni content is, therefore, from 30 to 50%.

C: When C is much more than 0.01%, the formation of iron carbide occurs, so that the etching property is impeded. A preferable upper limit is, therefore, 0.01%. Even solute carbon exerts detrimental effects upon the etching property. Less C is, therefore, more preferable. A more preferable upper limit of C is 0.005% or less.

Si: Si is added as a deoxidizing agent. Content of Si is, however, 0.20% or less, because Si exerts considerable influence upon the etching property and also upon the creep property.

Mn: Mn is added for the purpose of deoxidation and hot-workability. However, when the Mn content exceeds 0.5%, the tensile strength and yield strength are lowered and also the thermal expansion coefficient is increased. Therefore, Mn is preferably 0.5% or less.

P: P contained in excessive amount results in failure of the etching property, as in the case of Si. A preferable P content is therefore, 0.015% or less.

S: When S exceeds 0.010%, the sulfide-based inclusions increase so that the etching property is detrimentally influenced. A preferable upper limit is, therefore, 0.010% or less.

Final working degree: The present inventors intended to improve the creep property of an Fe—Ni alloy by means of increasing the final working degree by rolling so as to induce work hardening and hence the work-hardening temper state. The strength of such material is, thus, preliminarily enhanced. An experimental result obtained with increase in the final working degree from 0%, was that the creep property was enhanced. Although it was anticipated that the creep property would be enhanced with increase in the working degree, a phenomenon recognized was reduction in the creep property of material which was rolled at more than a certain working degree. The range of the final working degree was set based on such experimental results. A predetermined sheet thickness is obtained by working in the final cold-rolling. When its working degree is less than 30%, wrinkles are formed due to creep during the baking. When the working degree exceeds 57%, recrystallization begins during the blackening thereby lowering the high-temperature strength and the creep property. The working degree is, therefore not less than 30% and not more than 57%.

Tensile strength: When the tensile strength is less than 620 N/mm$^2$, wrinkles are likely to form during the mask assembling. The tensile strength of the Fe—Ni alloy after the final cold-rolling is, preferably, 620 N/mm$^2$ or more.

Yield strength (0.2%): When the yield strength (0.2%) is less than 610 N/mm$^2$, the mask plastically deforms under heat, that is, the creep phenomenon occurs, after the blackening, thereby incurring the wrinkles and a problem in the vibration. The yield strength (0.2%) of the Fe—Ni alloy after the final cold-rolling is, preferably, 620 N/mm$^2$ or more.

The method for producing the Fe—Ni alloy according to the,present invention is not different from that of the conventional material in the points of melting, casting, forging, hot-working, cold-working to obtain an intermediate sheet thickness, and intermediate annealing. The method according to the present invention is, however, characterized in the final step of cold working, particularly the cold-rolling, and is characterized by limiting the final working degree in the range described above. Since there is no change in the production process as is described above, increase in the production cost can be avoided. Incidentally, the thermal expansion coefficient of mild steel is poor and hence it is inappropriate as the material of the present invention. In addition, the Fe—Ni alloy according to the present invention is cold-rolled and is then subjected to the mask-assembling step. The shape of the alloy may be subjected to correction by means of a tension leveler and the like or to stress-relief annealing, if necessary, after the final cold-rolling and prior to the mask assembling. These treatments do not exert any significant influence upon the final temper state of the present invention.

In addition, a color Braun-tube can be manufactured by assembling the tension mask and such known parts as an electron gun, a glass panel having the face screen surface, a frame member, a panel pin and the like.

BEST MODE FOR CARRYING OUT INVENTION

The Fe—Ni alloys having the components shown in Table 1 were melted, and then the thickness was reduced to from 2 to 5 mm by means of forging and hot-rolling. The cold-rolling and bright annealing were then carried out to obtain various intermediate thickness.

TABLE 1

| | Chemical Components (% by weight) | | | | | | |
|---|---|---|---|---|---|---|---|
| No. | Ni | C | Si | Mn | P | S | Fe |
| 1 | 36.0 | 0.004 | 0.01 | 0.25 | 0.003 | 0.002 | Bal |
| 2 | 36.2 | 0.004 | 0.008 | 0.27 | 0.001 | 0.001 | Bal |
| 3 | 35.9 | 0.004 | 0.04 | 0.35 | 0.001 | 0.001 | Bal |

Material 1 of Table 1 was cold-rolled down to 0.1 mm of thickness, while changing the final working degree to various levels. The material was then heat-treated at the blackening temperature (500–600° C.) which is actually employed in the assembling of an FTM mask. The creep property was measured under the conditions of 460° C. for 20 minutes and 25 kgf/mm$^2$ of load. The direction of creep measurement (direction of load applied to the samples) was parallel to the rolling direction.

Figure 1:
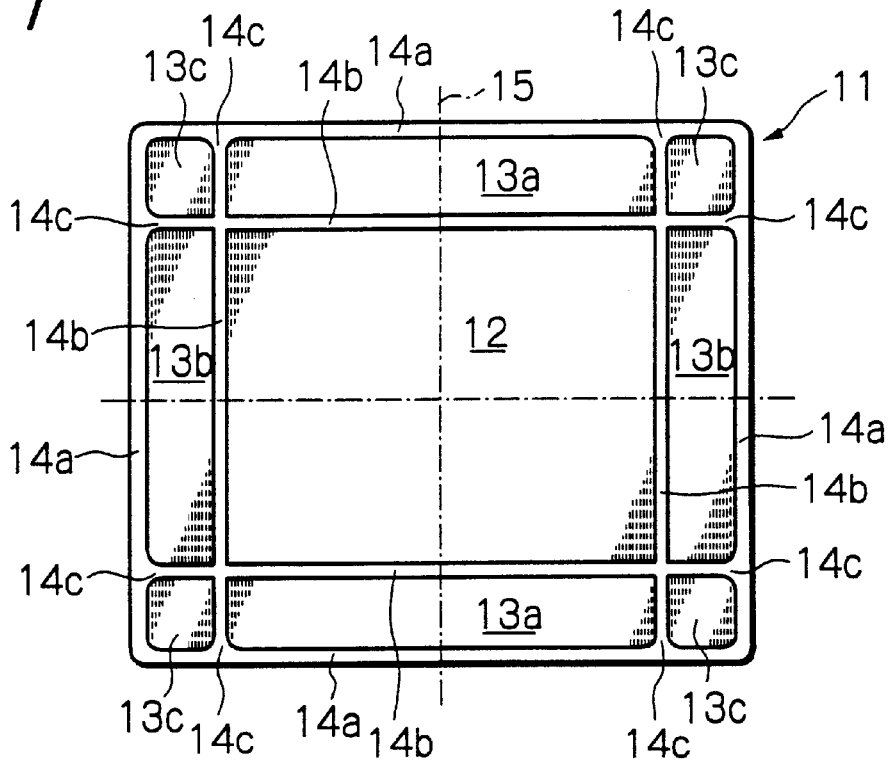
FIG. 1 is a plan view of the shadow-mask members shown in Japanese Unexamined Patent Publication No. 10-50210.
Figure 2:
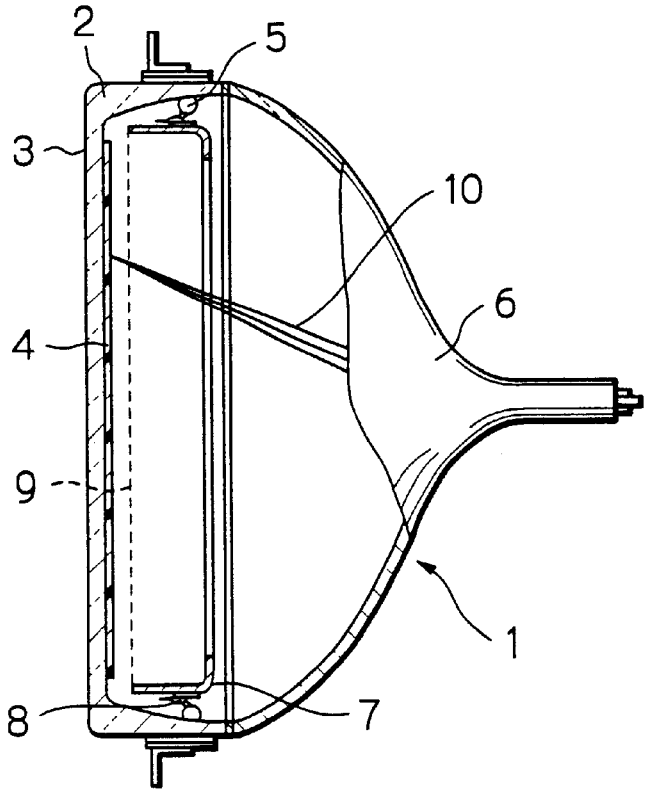
FIG. 2 is a partial cross sectional view of the cathode-ray tube shown in the above-mentioned publication.
Figure 3:
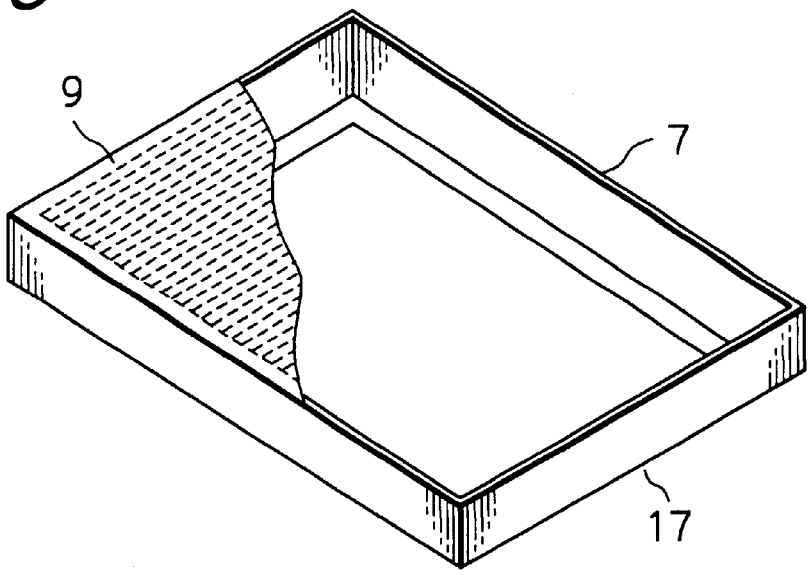
FIG. 3 is a side elevational view of the shadow mask shown in the above-mentioned publication.
Figure 4:
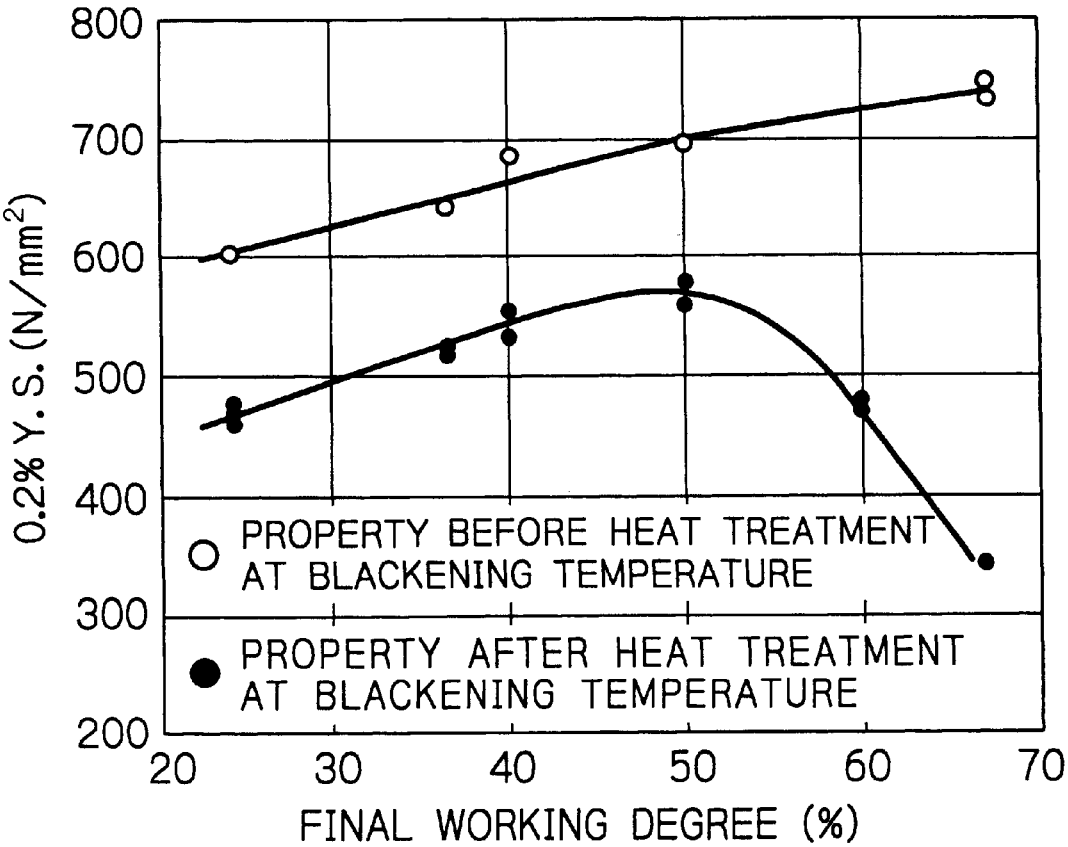
FIG. 4 is a graph showing the relationship between the final working degree and the 0.2% yield strength.

FIG. 4 shows the relationship between the final working degree and the yield strength (0.2%) prior and subsequent to the blackening. As is clear from FIG. 4, with an increase in the final cold-working degree, the yield strength of the material increases. However, the yield strength of the material heat-treated at the blackening temperature attains a peak at approximately 50% of the working degree(the decrease of the material thickness in percentage due to the working relative to the material thickness before working). Such yield strength decreases more at a higher working degree.

Figure 5:
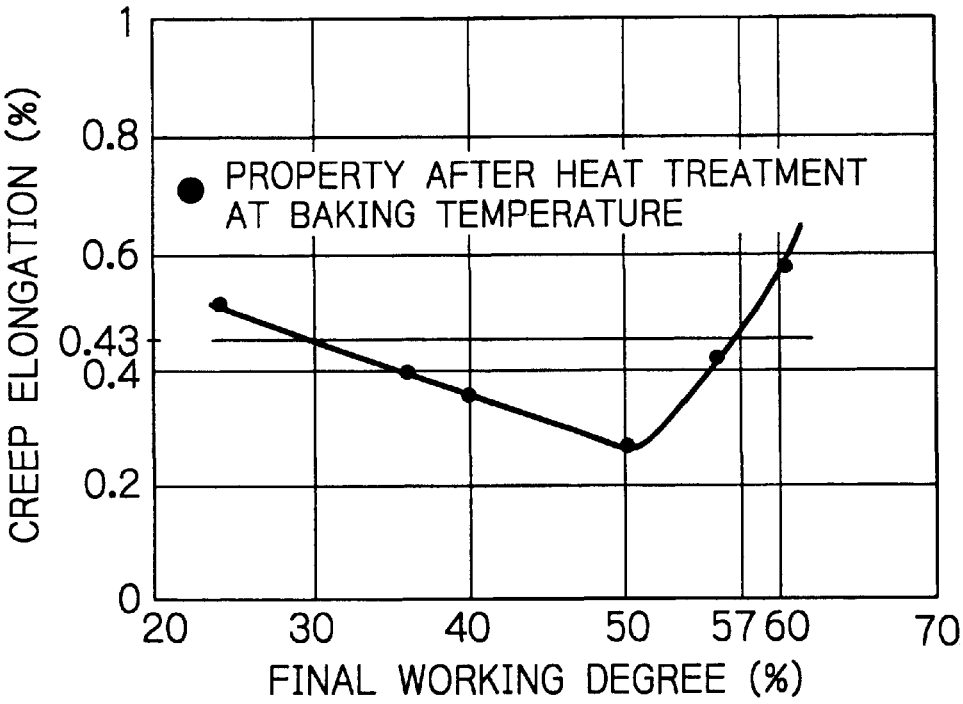
FIG. 5 is a graph showing the relationship between the final working degree and the creep property.

FIG. 5 shows the measurement result of the creep property of material, which has been heat-treated at the blackening temperature. Similar to the tendency seen in yield strength, the optimum creep property, that is, the smallest elongation, is obtained in the vicinity of 50% of the working degree. The creep property begins to deteriorate with further increase in the working degree. Production tests of the actual masks of the FTM type revealed that: material having 0.5% of creep elongation could not be used as the material of a shadow mask; and, material having 0.43% or less of creep elongation, i.e., slightly less than 0.5%, was usable.

In order to investigate the reason why the creep property is impaired at the final working degree exceeding the vicinity of 50%, the structure of the test materials was examined. It turned out that, when the material, which had been worked at the cold working degree exceeding 50%, was subjected to heat treatment at the blackening temperature and then the creep test, recrystallization began during the creep test. The conclusion thus reached was that the creep property and dislocations play an important role in the mask of the FTM type. More specifically, the dislocations introduced in a large amount into the material are intertwined in a complicated manner when the degree of the final cold working is increased. This results in suppression of the dislocation movement during the creep behavior, and hence in enhancement of the creep property. On the other hand, when the worked structure formed by the final cold working recrystallizes, the intertwining of dislocations introduced by the cold working tends to disappear thus impairing the creep property.

Figure 6:
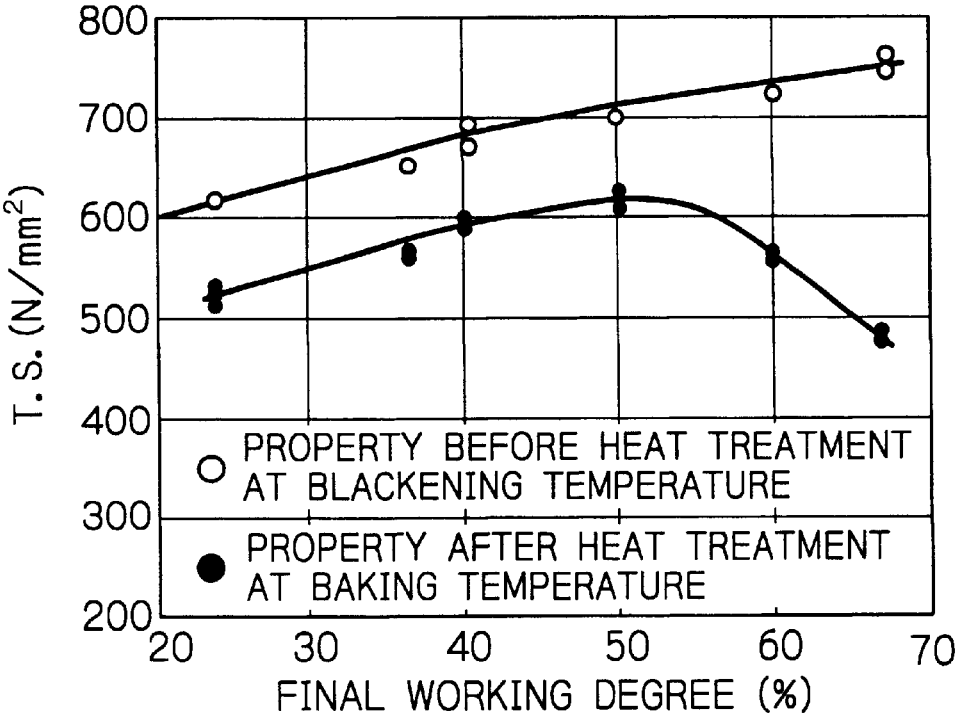
FIG. 6 is a graph showing the relationship between the final working degree and the tensile strength.

From FIG. 6 showing the relationship between the tensile, strength and the final working degree, it is apparent that high tensile-strength value is obtained even after the blackening, provided that the material, the temper of which is the final cold rolling, exhibits high tensile strength.

The same results were obtained also for Materials 2 and 3 of Table 1.

In FIG. 5, the horizontal line shown indicates 0.43% of the creep elongation. Creep elongation of less than this value indicates a usable region. Based on the above test results, the final cold working must be in a range of from 30 to 57% in order to attain the creep elongation in such region. In conformity with the creep elongation range, the yield strength and tensile strength of the finally cold-working finished material is 610 N/mm$^2$ or more and 620 N/mm$^2$, respectively.

INDUSTRIAL APPLICABILITY

The mask consisting of an Fe—Ni based alloy of the present invention has such dorming property and creep property that the alloy is suited as a color Braun-tube without the color distortion.

In addition, the tension mask of the present invention is suited for a color Braun-tube which enables flattening of a display:

Furthermore, the color Braun-tube of the present invention enables enhancement of the brightness and resolution.

What is claimed is:

1. A tension mask comprising an Fe—Ni alloy having an improved dorming property and creep property, which has cathode-ray passing apertures, in the form of dots or slots formed by etching, and to which tension is then vertically applied without undergoing press-forming, said Fe—Ni alloy containing from 30% by weight to 50% by weight of Ni, the balance consisting of iron and unavoidable impurities, and having not less than 30% and not more than 57% of the final working degree in the final temper state of the tension mask.

2. A tension mask according to claim 1, wherein the impurity components are 0.01% by weight or less of C, 0.20% by weight or less of Si, 0.5% by weight or less of Mn, 0.015% by weight or less of P, and 0.010% by weight or less of S.

3. An Fe—Ni alloy having an improved dorming property and creep property, which has cathode-ray passing apertures, in the form of dots or slots formed by etching, and to which tension is then vertically applied without undergoing press-forming, containing from 30% by weight to 50% by weight of Ni, the balance consisting of iron and unavoidable impurities, and having not less than 30% and not more than 57% of the final working degree in a final temper state wherein the final temper state is cold-working finish and having 620 $N/mm^2$ or more of tensile strength.

4. An Fe—Ni alloy according to claim 3, wherein the final temper state is cold-rolling finish and having 610 $N/mm^2$ or more of yield strength (0.2%).

5. A tension mask which has cathode-ray passing apertures, in the form of dots or slots formed by etching, and to which tension is then vertically applied without undergoing press-forming, and which consists of an Fe—Ni alloy containing from 30% by weight to 50% by weight of Ni, the balance consisting of iron and unavoidable impurities, and having not less than 30% and not more than 57% of the final working degree.

6. A tension mask according to claim 5, characterized by the impurity components of 0.01% by weight or less of C, 0.20% by weight; or less of Si, 0.5% by weight or less of Mn, 0.015% by weight or less of P, and 0.010% by weight or less of S.

7. A tension mask according to claim 5 or 6, characterized by being finally cold worked and subsequently shape corrected.

8. A tension mask according to claim 7, being further stress-relief annealed.

9. A tension mask according to claim 1 or 2, characterized by being finally cold worked and subsequently shape corrected.

10. A tension mask according to claim 9, being further stress-relief annealed.

11. A color Braun-tube, which comprises a tension mask which has the cathode-ray passing apertures in the form of dots or slots formed by etching, and to which tension is then vertically applied without undergoing press-forming, and which consists of an Fe—Ni alloy containing from 30% by weight to 50% by weight of Ni, the balance consisting of iron and unavoidable impurities, and having not less than 30% and not more than 57% of the final working degree.

12. A color Braun-tube according to claim 11, wherein the impurity components are 0.01% by weight or less of C, 0.20% by weight or less of Si, 0.5% by weight or less of Mn, 0.015% by weight or less of P, and 0.010% by weight or less of S.

13. A color Braun tube according to claim 11 or 12, characterized by being finally cold worked and subsequently shape corrected.

14. A color Braun-tube according to claim 13, being further stress-relief annealed.

15. A color Braun-tube according to claim 11, further comprising an electron gun, a glass panel having a face-screen surface, a frame member and a panel pin.

16. A tension mask according to claim 1 or 2, wherein the Fe—Ni alloy has a final temper state that is cold-working finish and has 620 $N/mm^2$ or more of tensile strength.

17. A tension mask according to claim 1, wherein the Fe—Ni alloy has a final temper state that is cold-rolling finish and has 610 $N/mm^2$ or more of yield strength (0.2%).

18. A color Braun-tube according to claim 13, further comprising an electron gun, a glass panel having a face-screen surface, a frame member and a panel pin.

* * * * *